US006971454B2

(12) United States Patent
Bogue

(10) Patent No.: US 6,971,454 B2
(45) Date of Patent: Dec. 6, 2005

(54) PULSED ROTATION SCREW REMOVAL AND INSERTION DEVICE

(76) Inventor: Edward M. Bogue, 155 Amston Rd., Colchester, CT (US) 06415

( * ) Notice: Subject to any disclaimer, the term of this patent is extended or adjusted under 35 U.S.C. 154(b) by 0 days.

(21) Appl. No.: 10/802,328

(22) Filed: Mar. 16, 2004

(65) Prior Publication Data

US 2005/0205274 A1 Sep. 22, 2005

(51) Int. Cl.[7] ..... B25B 15/00

(52) U.S. Cl. ..... 173/2; 173/176; 173/179; 318/281; 318/293

(58) Field of Search ..... 173/2, 176, 179, 173/181, 183; 318/280–282, 293

(56) References Cited

U.S. PATENT DOCUMENTS 3,519,907 A * 7/1970 White et al. ..... 318/122
4,689,534 A * 8/1987 Gerber et al. ..... 388/809
5,014,793 A * 5/1991 Germanton et al. ..... 173/181
5,357,179 A * 10/1994 Abbagnaro et al. ..... 318/17
5,361,852 A * 11/1994 Inoue et al. ..... 173/176
5,563,482 A * 10/1996 Shaw et al. ..... 318/272
5,731,673 A * 3/1998 Gilmore ..... 318/432
5,868,208 A * 2/1999 Peisert et al. ..... 173/178
6,479,958 B1 * 11/2002 Thompson et al. ..... 318/430
6,536,536 B1 * 3/2003 Gass et al. ..... 173/2

* cited by examiner

*Primary Examiner*—Stephen F. Gerrity
*Assistant Examiner*—Thanh Truong

(57) ABSTRACT

A drill/driver (e.g. an electric drill) with a screwdriver bit attachment, and a method of controlling the drill/driver, are described. This method of control will greatly reduce the occurrence of stripped screw heads on most types of screws. By periodically stopping insertion of a screw and reversing direction of the screwdriver bit, the screwdriver bit will be reinserted fully back into the screw head. By ensuring the screwdriver bit is always fully inserted in the screw head, the stripping of a screw head will be prevented. This can be easily implemented on most types of powered screwdrivers including the most common device used for screw insertion on a construction job site, the cordless drill/driver.

20 Claims, 4 Drawing Sheets

DRILL/DRIVER

MANUAL CONTROLS

SEMI-AUTOMATIC CONTROL

AUTOMATIC CONTROLS

PULSED ROTATION SCREW REMOVAL AND INSERTION DEVICE

CROSS-REFERENCE TO RELATED APPLICATIONS

Not Applicable

STATEMENT REGARDING FEDERALLY SPONSORED RESEARCH OR DEVELOPMENT

Not Applicable

STATEMENT REGARDING FEDERALLY SPONSORED RESEARCH OR DEVELOPMENT

Not Applicable

BACKGROUND OF INVENTION

Figure 1:
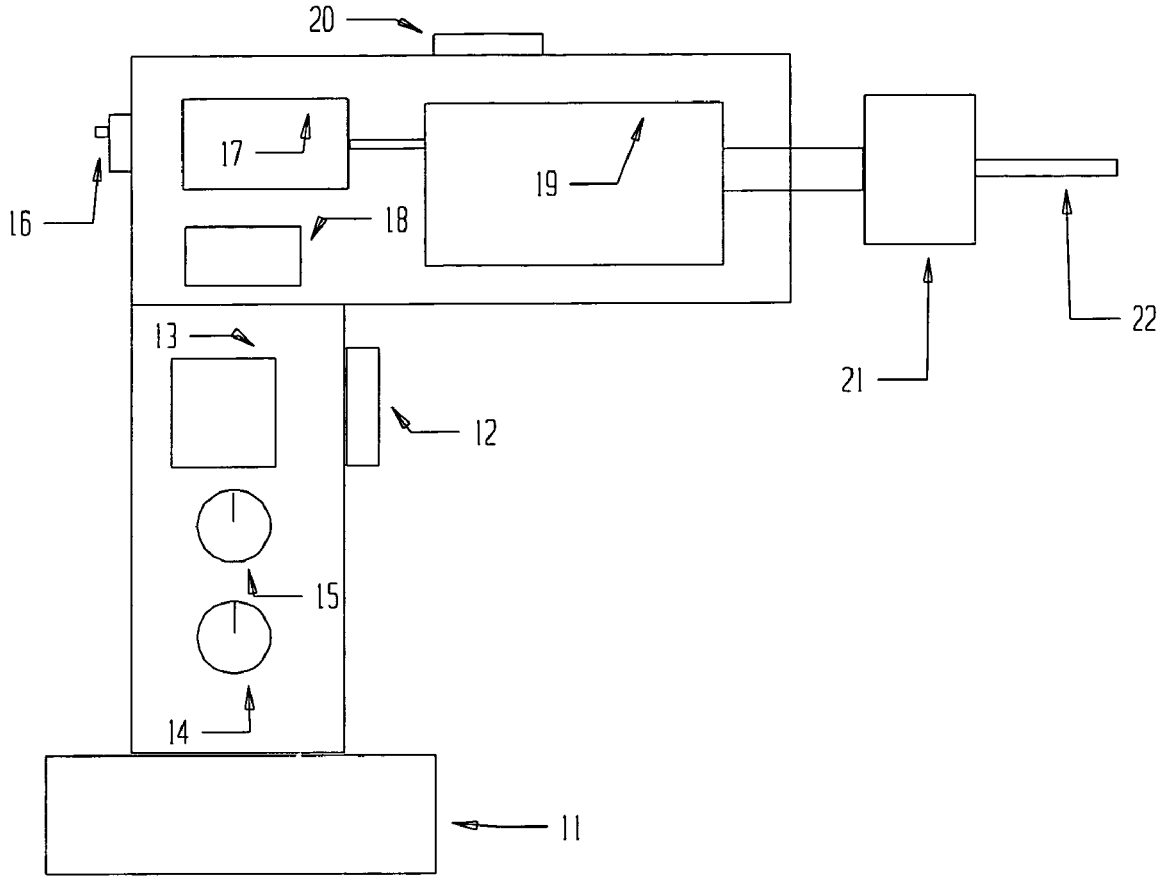

This invention relates to power tools used to insert screws, specifically an improved drill/driver design to reduce the occurrence of stripped screws.

BACKGROUND

The invention has particular reference to hand-held and bench-mounted power screwdrivers and power drills with a screwdriving facility, and which are referred to as "drill/drivers" herein.

The invention has particular reference to fasteners with threads. These fasteners include screws, bolts, or any fastener which require rotation of a driving device for installation, and which are referred to as "screws" herein.

Many different screw head designs have been made to avoid the problem of stripped heads; square drive heads, hex heads, and torque heads. Attempts have been made to improve the screwdriver assembly, such as an impact driver. One example of an impact driver is U.S. Pat. No. 4,919,216, this type of impact driver is good for extremely difficult to move screws, but poor for efficient inserting and removal of screws. A power-driven screwdriver with torque-dependent release clutch, such as U.S. Pat. No. 6,173,792, can be of some use in avoiding stripped screws. The problem using a torque limiting device is the inability to insert screws requiring high torque. Some of these solutions have improved performance in some applications, but this problem of stripped heads still exist.

One of the most common screws used is the Philips head screw. The Philips head screw is one of many which are prone to having the bit hop out of the screw head.

In order to reduce the occurrence of stripped screw heads in a relatively high torque situation, the screwdriver bit must have a very high force pushing it into the screw head. There are situations in construction where this increased force is difficult or dangerous to apply, such as when the drill/driver operator is on a ladder or roof. There are many different applications requiring a relatively high torque, such as a very small screw head, a long screw, or inserting the screw into a dense material.

The problem of the stripped screw heads is worst when the torque limit of the screw is approached. As a relatively high torque is placed on a screw, the screwdriver bit will work itself out a small amount with each revolution of the screw. To prevent the screwdriver bit from coming out of the screw a significant force is required on the screwdriver pushing the screwdriver bit into the screw head. When the screwdriver bit has pulled out of the screw too far, the screwdriver bit will slip relative to the screw. Each time the screwdriver bit slips in the screw, the head of the screw is damaged. When too much damage is done to the screw, the screwdriver bit can no longer grip the screw head with enough force to turn it.

BRIEF SUMMARY OF INVENTION

This invention will greatly reduce the occurrence of stripped screw heads on types of screws that are prone to having the bit hop out of the screw head. Momentarily stopping clockwise rotation of a screw and reversing direction of the drill/driver bit for a fraction of a second will prevent stripping of screw heads. The drill/driver will periodically automatically reverse direction, at a frequency and duration based on provided adjustments or automatic settings.

When a screw is screwed in, the screwdriver bit will incrementally work its way out of the screw head with each revolution. This invention allows the screwdriver to momentarily reverse direction. Reversal of the drill/driver allows the screwdriver bit to be inserted fully back into the screw head with moderate pressure of the screwdriver bit against the screw head. After the screwdriver bit is fully inserted back into the screw head, the screwdriver again begins forward rotation to rotate the screw further in. The reversal time should be sufficient to allow the screwdriver bit to be reinserted into the screw head, but not sufficient time to rotate the screw significantly backwards. The frequency of reversals should be adjusted such that the drill will be reversed often enough to reinsert the screwdriver bit back into the screw head before the screw starts to slip.

This invention will improve the drill/driver's ability to insert any screw, which is prone to having the bit hop out of the screw head. Some of the screws included in this are the Philips head, Hex head, Square drive, and the slotted head. Due to the increased driving ability of the drill/driver, in some cases the screw strength becomes the weak link in driving a screw. The screw head or shank can have a higher torque than normal, causing the screw itself to break. A hardened steel or other suitable material would be required in some installations. Some types of screw heads may not be compatible with the reversal pulse if the pulse is of too long duration, such tamperproof screws that don't allow counterclockwise rotation.

OBJECTS AND ADVANTAGES

1: A reduction in occurrence of stripped screws heads.

2: A reduction in required pressure on the screwdriver bit against the screw head in order to prevent the stripping of screw heads.

3: A reduction in wear on screwdriver bits due to slipping or near slipping of screwdriver bit to screw head.

4: An increase in the maximum torque able to be applied to a screw without the screw head being stripped.

BRIEF DESCRIPTION THE DRAWINGS

FIG. 1: This is a diagram showing the parts contained in a typical drill/driver, plus the additional parts required for this invention.

11 Battery

12 Trigger

13 Control Box

14 Frequency Control

Figure 2:
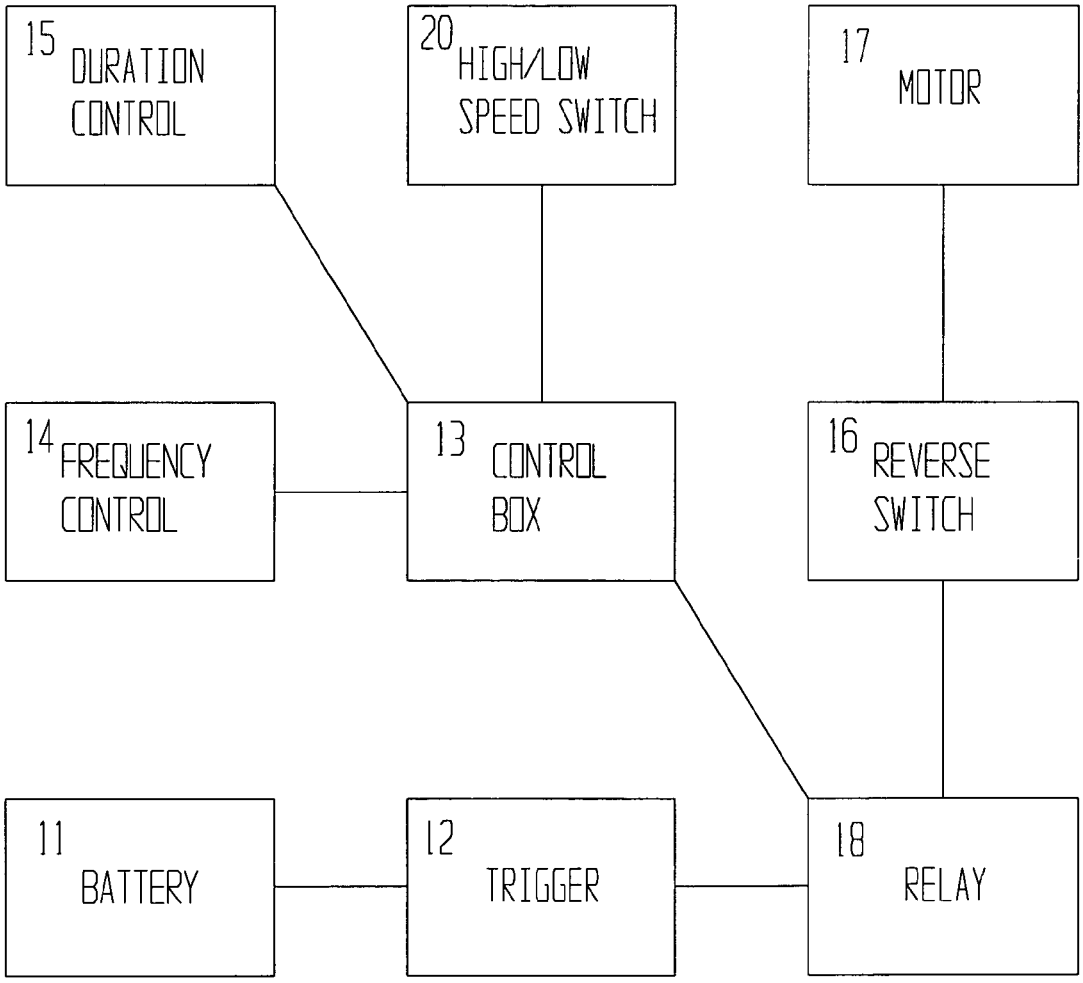

15 Duration Control
16 Reverse Switch
17 Motor
18 Relay
19 Gear Assembly
20 High/Low Gear Switch
21 Chuck Assembly
22 Screwdriver Bit FIG. 2: This is a block diagram for the manual adjustment implementation of the device.

Figure 3:
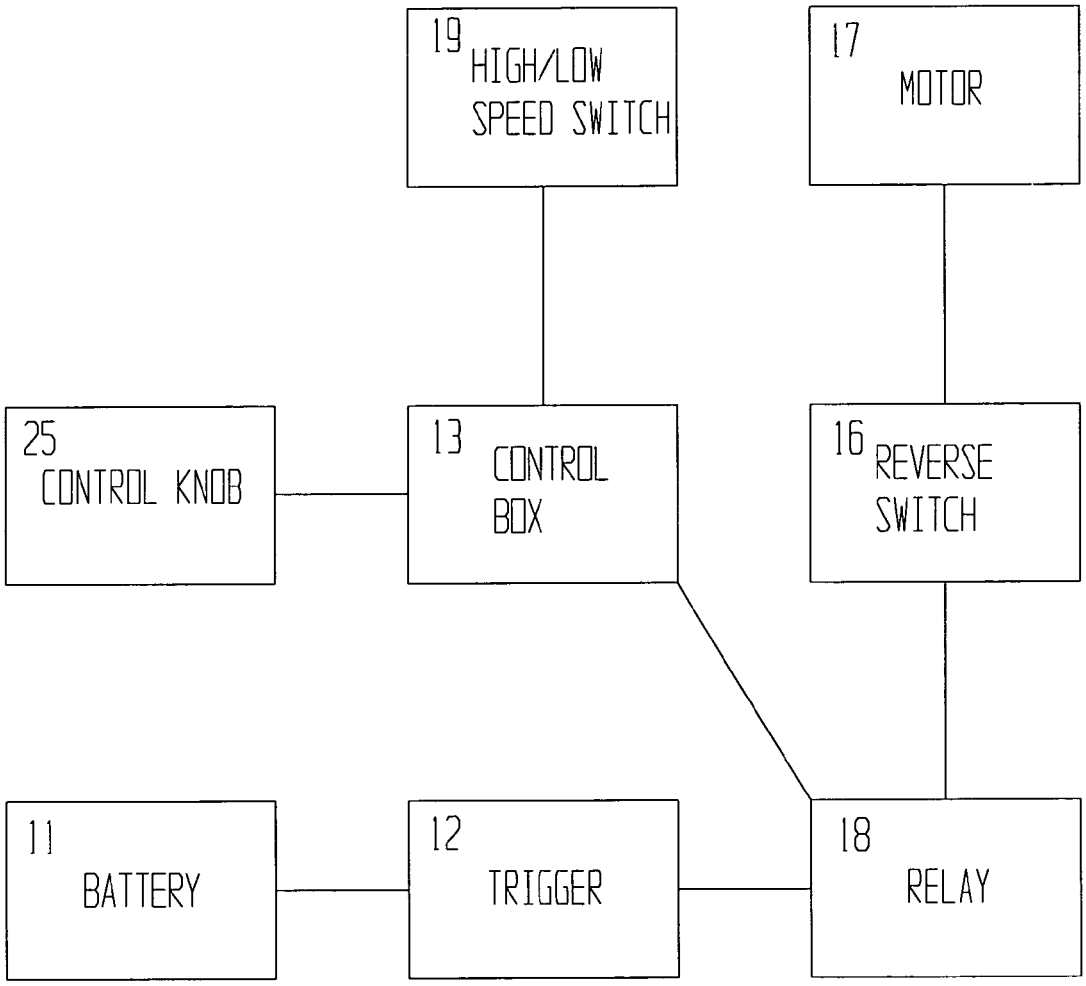

11 Battery
12 Trigger
13 Control Box
14 Frequency Control
15 Duration Control
16 Reverse Switch
17 Motor
18 Relay
20 High/Low Gear Switch FIG. 3: This is a block diagram for the semi-automatic adjustment implementation of the device.

Figure 4:
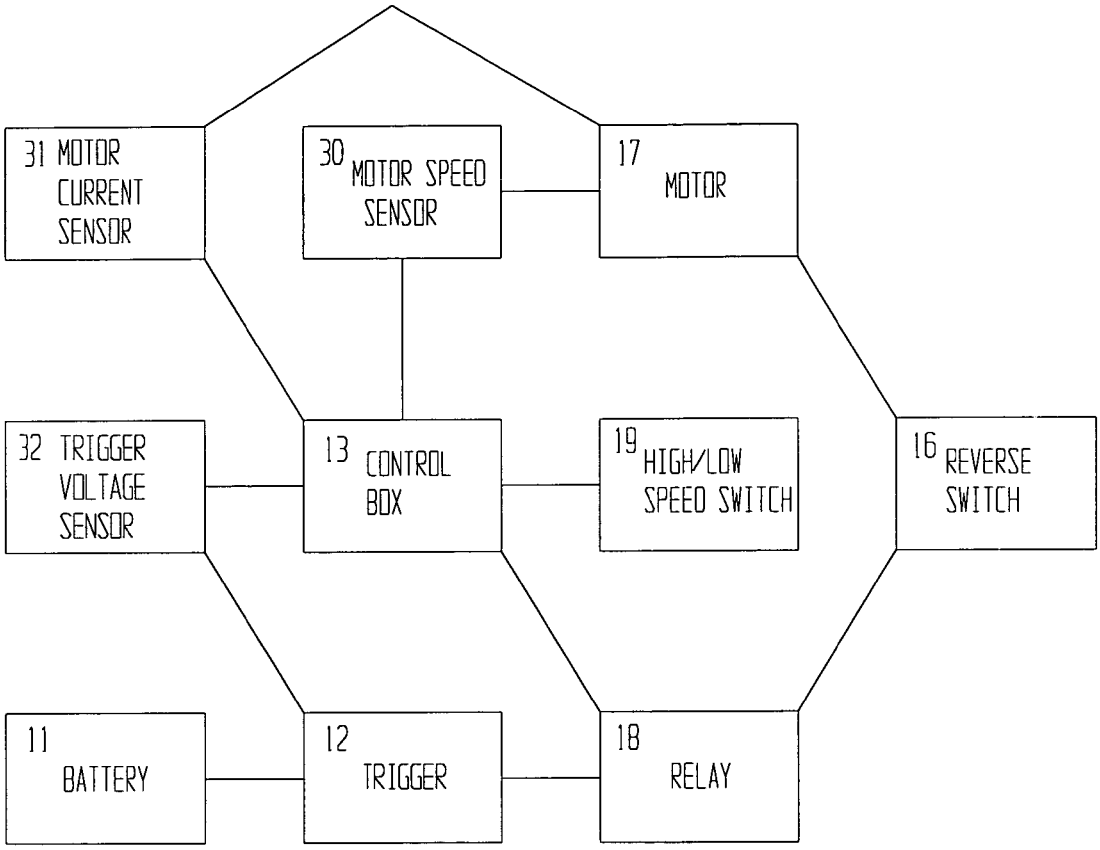

11 Battery
12 Trigger
13 Control Box
16 Reverse Switch
17 Motor
18 Relay
19 High/Low Gear Switch
25 Control Knob FIG. 4: This is a block diagram for the automatic adjustment implementation of the device.

11 Battery
12 Trigger
13 Control Box
16 Reverse Switch
17 Motor
18 Relay
19 High/Low Gear Switch
30 Motor Speed Sensor
31 Motor Current Sensor
32 Trigger Voltage Sensor

DETAILED DESCRIPTION OF THE INVENTION

Preferred Embodiment: Manual Controls (FIGS. 1,2)

Description of Invention

This example is for a cordless drill/driver. Connections of electrical components are made with insulated electrical wire. The positive side of the DC battery pack (11) is connected to input of the trigger (12). The output of the trigger (12) is connected to common 1 of a DPDT (double pull double throw) relay (18). The negative side of the DC battery (11) pack is connected to the common 2 of a DPDT relay (18). The NO (normally open) 1 and NC (normally closed) 2 of the relay (18) are connected to the positive side of the reverse switch (16). The NO 2 and NC 1 of the relay (18) are connected to the negative side of the reverse switch (16). The relay (18) is connected to the control box (13). The duration control (15) is connected the control box (13). The frequency control (14) is connected to the control box (13). The high/low gear switch (20) which indicates which gear the drill/driver is in is connected to the control box (13). The control box (13) is connected to the DC battery (11). The reverse switch is connected to the motor (17) using two wires.

The output of the motor (17) is connected to a gear assembly (19), which will change the drill/driver from high to low gear. The output of the high or low speed gear is connected to an output shaft of the drill/driver. For this example the output shaft arranged to mount a screwdriver and screwdriver bit will be the chuck assembly (21). Mounted in the chuck assembly (21) will be a screwdriver bit (22) For design which are exclusively used for driving screws, the output could be specifically designed to mount a screwdriver bit (22).

Operation of Invention

The trigger (12) controls the amount of power transferred from the battery (11) to power the motor (17). The reverse switch (16) changes polarity at the motor (17), thus reversing the direction of the motor (17) and the chuck assembly (21). The DPDT relay (18) will reverse the direction of the motor (17) when the relay's (17) coil is triggered. The control box (13) will use the duration control (15) to adjust the time of reversal in each reverse rotation cycle. The frequency control (14) will control the period of reversals of the motor (17). The high/low gear switch (20) will indicate which gear the drill/driver is in, used to disable the reversing system in high gear.

When the drill/driver is in the high speed setting, it can be assumed that either a drilling operation is being performed or a screw is being inserted with relatively low torque. Neither of the preceding applications would benefit from having the reversing feature operational, therefore, the reversing function should be disengaged by the high/low gear switch (20) when it indicates the drill/driver is in high gear.

When the drill/driver is in low gear mode, the reversing feature will be enabled. When a screw is screwed in using this high torque mode, the screwdriver bit (22) may start to work its way out of the screw head. Reversing the rotation of the screwdriver bit (22) allows the screwdriver bit (22) to be inserted fully back into the screw head with only moderate pressure forcing the screwdriver bit (22) back into the screw head. After the screwdriver bit (22) is fully reinserted, the screwdriver again begins forward rotation to rotate the screw further in. The duration control (15) will need to be adjusted differently based on the exact type of screw, and construction material used. The duration of reversals should be sufficient to allow the screwdriver bit (22) to be reinserted into the screw head, but not sufficient time to rotate the screw significantly backwards. The frequency control (14) will also need to be adjusted differently based on the exact type of screw, and construction material used. The frequency of reversals should be adjusted such that the screwdriver bit (22) will be reversed often enough to reinsert the screwdriver bit (22) back into the screw head before the screw starts to slip.

A prototype drill/driver was constructed and tested using this preferred embodiment. On the prototype unit it was found the optimum reversal duration would increase with an increase in rotational inertia. Rotational inertia would increase with a greater rotational mass, and higher rotational speed. On the prototype unit it was also found the optimum reversal frequency would increase with either increased torque, or increased rotational speed. The manual controls on the drill/driver gives the operator the all the adjustment necessary for perfect optimization of the anti-stripping function.

Alternative Embodiment: Semi-Automatic Controls (FIG. 3)

This embodiment of the invention is similar to the previous example, except the control adjustments are simplified. For some users of a drill/driver, both a frequency adjustment and a duty cycle adjustment may be too difficult or time consuming to use. By eliminating one or both of these adjustments the device becomes more simple and easier to use.

These controls could be combined into one adjustment a control knob (25), with a higher frequency and longer reversal time tied to a higher position of the adjustment.

Second Alternative embodiment: Automatic controls (FIG. 4)

This embodiment of the invention is similar to the previous example, except the control adjustments are simplified further. For some users of a drill/driver, any adjustment may be too difficult or time consuming to use. By eliminating these adjustments the device becomes more simple and easier to use.

The frequency control (14) and duration control (15) could be completely removed, and a control box (13) can control the task. This control box (13) can be a simple analog circuit or a processor chip. This inputs to this control box (13) can be motor speed, motor input current, trigger position. The motor speed sensor (30) can be hooked up to either a pulsed output of the motor (17), or sensing the AC component of input current. The motor (17) input current can be measured using a standard measurement of voltage drop. This input current is useful because it should be roughly proportional to motor (17) output torque. The trigger (12) position can be measured using the trigger voltage sensor (32) with a variable resistor which changes with trigger (12) position, or the position can be calculated by measuring the output voltage of the trigger (12). The processor can then correlate the output voltage of the trigger (12) to a corresponding trigger position sensor (32) output. From these inputs, the control box (13) can make a good assumption what type of task the drill/driver is being used for. If the drill/driver is drilling, the speed will generally be high, and the torque low. When a screw is being inserted, the speed will generally be low, and the motor (17) current high. An algorithm can be generated for the drill/driver to optimize adjustments of the frequency and duration of reversals using some or all of the following guidelines.

1. The higher the motor speed, the longer the reversal duration.
2. The higher the motor speed, the higher the frequency of reversals.
3. The higher the motor current, the higher the frequency of reversals.
4. Disable the reversing function if not in low gear.
5. The closer the trigger position is to the full power position, the higher the frequency of reversals Third Alternative Embodiment: Mechanical Implementation The pulsed momentary reversals can be accomplished through mechanical means in some cases. This can be implemented in the drill/driver assembly or external to the drill/driver, for example in the chuck mechanism. One way of implementing this mechanically would be to use a planetary gear set between the input and output of the chuck. The output of the chuck would turn at a slower rate than the input. This speed differential allows a means for internally counting revolutions of the chuck, and a means to power the reversal stroke. The reversal stroke can be implemented by using a spring and an impact weight to force the reversal. This could be further simplified by causing a periodic momentary disengagement rather than a reversal of the output shaft. The disengagement method would not be as effective in avoiding stripped screw heads, but may have a decreased cost of production. The mechanical design could also be implemented inside the drill/driver using a mechanical revolution counter or electrical actuation for the reversal or disengagement implementation. In the disengagement implementation, the torque limiting clutch or slip spring in a standard drill/driver could be used as the means for disengagement.

CONCLUSION: Accordingly, the reader will see the suspension device in this invention will:

- Reduce the occurrence of stripped screw heads.
- Reduce the required pressure on the screwdriver bit against the screw head to prevent stripping of screw heads.
- Reduce wear on screwdriver bits due to slipping or near slipping of screwdriver bit to screw head.
- Increase the maximum torque able to be applied to a screw without the screw head being stripped.

Although the description above contains many specifications, these should not be construed as limiting the scope of the invention, but merely providing illustrations of some of the presently preferred embodiments of this invention. There are some of the many other variations possible for implementing this invention:

- The frequency could be fixed to a predetermined value.
- The reversal duration can be fixed to a predetermined value.
- The switch to turn off the reversal function can be a separated switch or integrated into any of the adjustments provided. Simply changing the frequency or duration of reversals to zero would disable the reversal functions.
- The control box can be integrated into the trigger assembly.
- The control box can be built into the battery assembly, allowing upgrading of some older drill/drivers.
- The vertical load on the output shaft can be measured, and the duration and/or frequency of the reversals could change with a changing vertical load. This would allow the reversals to be enabled or increase in frequency and increased duration only when the bit has a high vertical load on the screw. This would avoid reversing on screws which are easy to insert, and enable reversing on the difficult to insert screws which operators naturally increase the vertical force while inserting.
- The relay can be replaced with solid-state components.
- The reversal period can be based on the revolution rate of the output shaft, rather than time based.
- The reverse polarity pulse to the motor could be gradual instead of instantaneous. This would slow down the response of the reversals, but put less stress on the motor and drive mechanism.
- Instead of reversing the motor, the power to the motor could simply be cut. This may reduce cost and place less strain on the drive mechanism, but will reduce some effectiveness of the anti-stripping feature.

To avoid damage to the drill/driver's motor and gear drive mechanism from the repeated reversal shock, a shock absorption device may be placed inline with the gear drive section.

There may some instances where the reversing feature may be desired when the drill/driver is in high gear. In this case the high/low speed switch should not disengage the reversing function.

The automatic control of frequency and duration can be based off any combination of motor speed, output shaft speed, trigger position, and motor current.

Thus, the scope of the invention should be determined by the appended claims and their legal equivalents, rather than by the examples given.

I claim:

1. A drill/driver including a rotatable output shaft arranged to mount a screwdriver and screwdriver bit and a motor for rotatably driving said rotatable output shaft, providing a means for automatically periodically momentarily stopping rotation of said rotatable output shaft, followed by momentary reversing the rotation of the output shaft, followed by momentarily stopping rotation of said rotatable output shaft followed by a return to forward rotation.

2. A device in claim 1 which includes a fixed duration of said automatic periodic momentary reversals.

3. A device in claim 1 which includes an adjustable duration of said automatic periodic momentary reversals.

4. A device in claim 1 which includes a fixed frequency of said automatic periodic momentary reversals.

5. A device in claim 1 which includes an adjustable frequency of said automatic periodic momentary reversals.

6. A device in claim 1 which includes a relay to achieve reversal of said output shaft.

7. A device in claim 1 which includes a means to automatically change duration of said automatic periodic momentary reversals whereby the duration is based partially or entirely on trigger position.

8. A device in claim 1 which includes a means to automatically change duration of said automatic periodic momentary reversals whereby the duration is based partially or entirely on said motor speed.

9. A device in claim 1 which includes a means to automatically change duration of said automatic periodic momentary reversals whereby the duration is based partially or entirely on said rotatable output shaft speed.

10. A device in claim 1 which includes a means to automatically change duration of said automatic periodic momentary reversals whereby the duration is based partially or entirely on said motor current.

11. A device in claim 1 which includes a means to automatically change frequency of said automatic periodic momentary reversals whereby the frequency is based partially or entirely on trigger position.

12. A device in claim 1 which includes a means to automatically change frequency of said automatic periodic momentary reversals whereby the frequency is based partially or entirely on said motor speed.

13. A device in claim 1 which includes a means to automatically change frequency of said automatic periodic momentary reversals whereby the frequency is based partially or entirely on said rotatable output shaft speed.

14. A device in claim 1 which includes a means to automatically change frequency of said automatic periodic momentary reversals whereby the frequency is based partially or entirely on said motor current.

15. A device in claim 1 which includes a switch to engage and disengage said automatic periodic momentary reversals function.

16. A device in claim 1 which includes a means allowing said automatic periodic momentary reversals function to be engaged only when said drill/driver is in a low speed gear.

17. A device in claim 1 which includes a means to disable an automatic control of frequency and duration of said automatic periodic momentary reversals, and enable a manual control of said automatic periodic momentary reversals.

18. A device in claim 1 which includes a mechanical device to provide means of said automatic periodic momentary reversals.

19. A device in claim 1 whereby the means for said automatic periodic momentary reversals is contained within a battery assembly for a cordless drill/driver.

20. A device in claim 1 which includes a means to automatically change duration and/or frequency of said automatic periodic momentary reversals based partially or entirely said output shaft vertical load.

* * * * *